United States Patent [19]

Cavallaro et al.

[11] Patent Number: 5,072,668

[45] Date of Patent: Dec. 17, 1991

[54] PRINTING APPARATUS

[76] Inventors: Raymond J. Cavallaro, 1776 Brookview Cir., Bloomfield Hills, Mich. 48013; Edward Ferrari, 317 E. 8 Mile, Hazel Park, Mich. 48030

[21] Appl. No.: 680,357

[22] Filed: Apr. 4, 1991

[51] Int. Cl.[5] ..... B41F 17/08

[52] U.S. Cl. ..... 101/39; 101/269; 101/338

[58] Field of Search ..... 101/38.1, 39, 56, 269, 101/325, 338, 40, 40.1

[56] References Cited

U.S. PATENT DOCUMENTS

| | | | |
|---|---|---|---|
| 1,135,243 | 4/1915 | Wright . | |
| 2,564,657 | 7/1949 | George | 101/36 |
| 3,577,917 | 5/1971 | Nantz | 101/269 |
| 4,015,525 | 4/1977 | Shenoha | 101/333 |
| 4,024,813 | 5/1977 | Thiene | 101/269 |
| 4,628,811 | 12/1986 | Lozen | 101/38 R |

*Primary Examiner*—Edgar S. Burr

*Assistant Examiner*—Stephen R. Funk

*Attorney, Agent, or Firm*—Basile and Hanlon

[57] ABSTRACT

A printing apparatus is disclosed having stationary frame members disposed at an angle with respect to one another and supporting an ink storage member on one portion while supporting an image carrier member on the other portion. A movable member is capable of rotation and reciprocation, and supports an ink transfer member and a pressure applying member. When in a first angular position, the movable member will bring the ink transfer member and the pressure applying member into operable engagement or position with said ink storage member and said image carrier member respectively when reciprocated between first and second end limits of travel. When the movable member is disposed in a second angular position, the ink transfer member is brought into operable engagement or position with respect to the image carrier means as the movable member is reciprocated between first and second end limits of movement.

20 Claims, 4 Drawing Sheets

PRINTING APPARATUS

FIELD OF THE INVENTION

The invention relates to marking or printing machinery and, more particularly, to a cyclic imprint apparatus for marking or printing messages and/or designs on flat articles, such as paper goods, including party napkins, business cards, matchbook covers, or the like, or in a modified form for imprinting text and/or logos on plastic drinking cups.

BACKGROUND OF THE INVENTION

A large variety of devices are previously known for printing on flat articles or for printing on plastic drinking cups. For example, U.S. Pat. No. 4,628,811 discloses a cup printer including an endless belt ink cartridge. The cup printing assembly includes ink transfer rollers for forming an ink image from an ink reservoir and transferring the ink image to a cup. The ink reservoir stores the ink to be transferred. The assembly is characterized by the ink reservoir being an absorbent continuous belt member for retaining ink thereon.

U.S. Pat. No. 4,015,525 discloses an imprinter and actuator therefor. The imprinting device includes a frame member having a power cylinder mounted thereon with a power arm ram reciprocable in a first direction. A rigid non-sliding linkage connects the ram to a pivotable yoke member carried by the frame which, in turn, is pivotally connected to a type of stamp pad carrying member. The type of carrying member is pivotable around a fixed point on the frame through a lost motion connection. The stamp has a vertical stamping movement and a horizontal inking movement. In the vertical movement, the stamp projects above a plane of the frame, while in the horizontal movement, it is brought into contact with a disposable ink cartridge carried by the frame. Other types of printing machines for marking flat articles are disclosed in U.S. Pat. No. 4,024,813, U.S. Pat. No. 3,577,917, U.S. Pat. No. 2,564,657, and U.S. Pat. No. 1,135,243. While these devices perform their intended function, each machine is limited with respect to the type of article that it can mark or imprint.

SUMMARY OF THE INVENTION

The printing apparatus of the present invention is adapted to be capable of imprinting or marking either flat articles or plastic drinking cups with easy changeover between the two types of printing. The invention relates to an imprinting machine for printing on paper goods, such as party napkins, business cards, matchbook covers or the like, or when an alternate interchangeable part in a modified form is selected, for imprinting logos and/or text on plastic cups or the like. The present invention includes a base with a reciprocal rod supported by the base for movement along a longitudinal axis of the rod and rotation about the longitudinal axis of the rod. In a first embodiment, an assembly is attached to one end of the rod. The first assembly includes an inking roller, a pressure roller, an alignment rod and a manual handle or other stroke and rotation inducing means. The ink transfer roller and the pressure roller have longitudinal axes of rotation disposed generally perpendicular to one another. A typeset holder is disposed in one plane with respect to the base, while an ink pad is disposed on another plane generally perpendicular to the first plane. When the rod is reciprocated in a first direction, the ink transfer roller is applied to the typeset holder to transfer ink from the transfer roller to the typeset and/or logo in the holder. Upon reaching the end limit of travel in that direction, the rod and attached assembly are rotated through 90° to orientate the ink transfer roller with respect to the inking pad and simultaneously to orientate the pressure roller with respect to the typeset holder. The appropriate paper stock is then positioned over the typeset holder, and the assembly and rod are reciprocated in the opposite direction, causing the ink to be transferred to the paper stock and the ink transfer roller to come in contact with the ink pad. After completion of reciprocation in this direction, the rod and attached assembly are rotated 90° to again orientate the ink transfer roller with respect to the typeset holder for reciprocation in the opposite direction as previously described.

A second assembly can be selected and interchanged with the first assembly of the present invention, such that the pressure roller is replaced with a cup holder. The device operates in essentially the same manner as previously described above. For example, with the ink transfer roller positioned with respect to the typeset holder, ink is transferred to the typeset and/or logo while reciprocating the rod and attached assembly in a first direction. After reaching the end limit of travel in the first direction, the rod and assembly are rotated through 90° to orientate the ink transfer roller with respect to the ink pad, while simultaneously orientating the cup holder with respect to the typeset holder. A cup is then positioned on the cup holder and the rod and assembly are reciprocated in the second direction, drawing the cup across the typeset holder to transfer the printed matter to the cup, while simultaneously inking the ink transfer roller. After reaching the second end limit of travel, the rod and assembly are again rotated through 90° to orientate the ink transfer roller with respect to the typeset holder. The printed cup is then removed from the cup holder.

The present invention is designed for manual operation to provide low volume and low cost novelty items for personal use, such as parties and the like. This provides a printing device for use by small party stores in filling special orders. However, it is anticipated that the present invention could be automated to various degrees, if desired.

BRIEF DESCRIPTION OF THE DRAWINGS

Other objects and features of the invention will become apparent by reference to the following detailed description and to the drawings, in which like reference numerals refer to the same elements throughout the various views, and wherein.

DETAILED DESCRIPTION OF THE PREFERRED EMBODIMENTS

Figure 1:
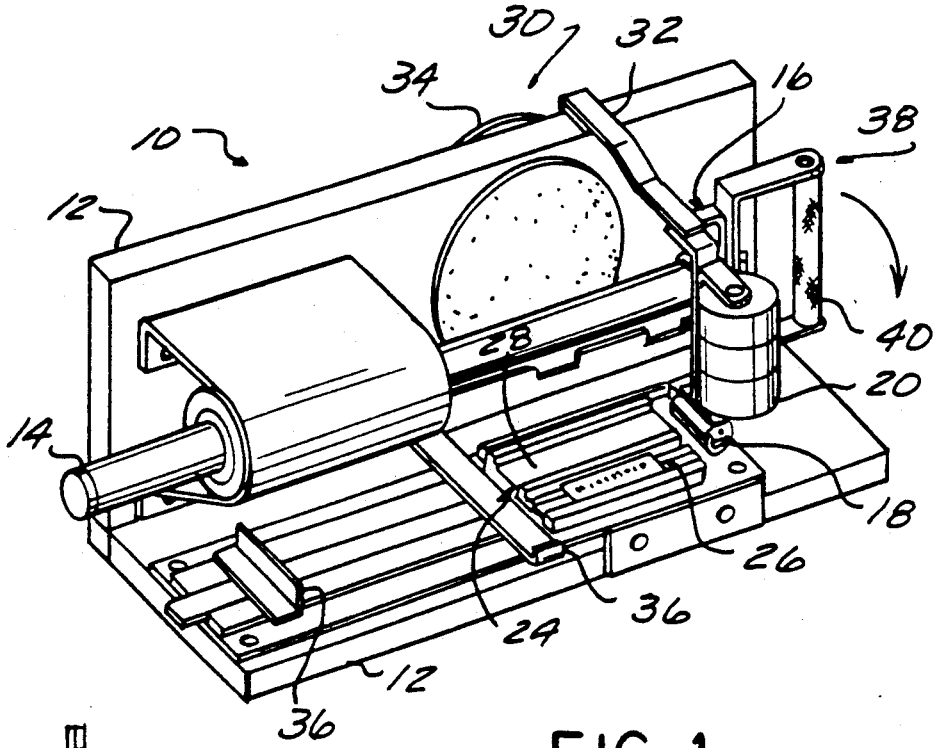
FIG. 1 is a perspective view of the present invention with first sub-assembly for imprinting flat articles.
Figure 2:
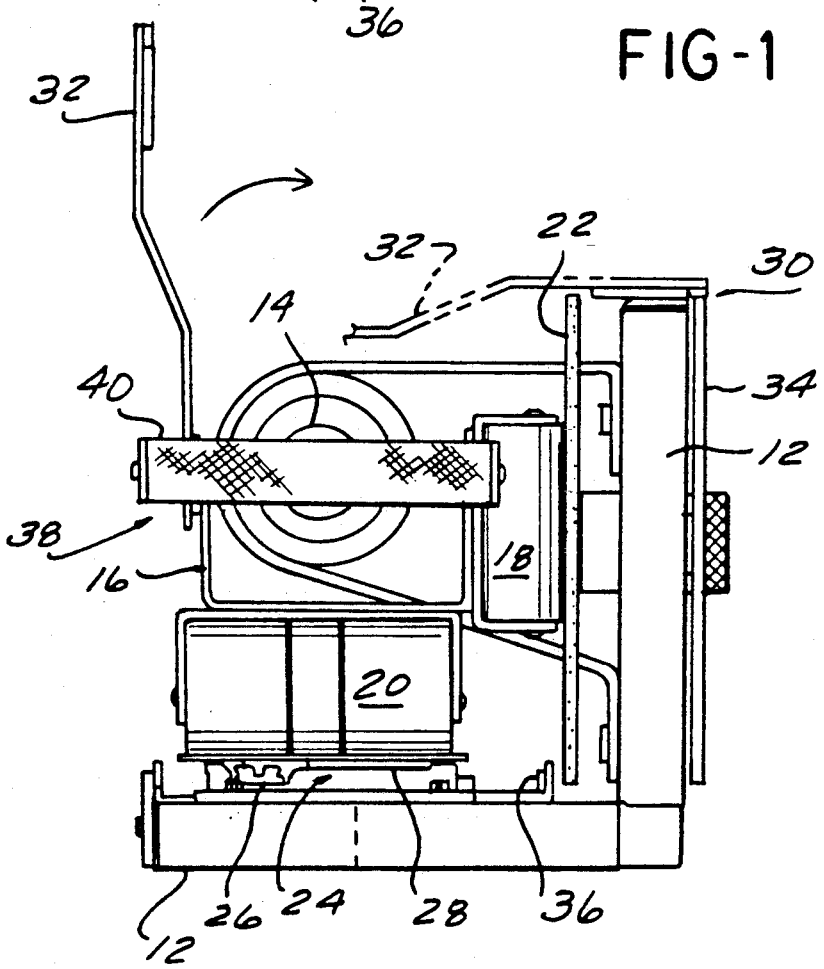
FIG. 2 is an end view of the printing apparatus of the present invention as shown in FIG. 1.

The first embodiment of the present invention of a printing apparatus, generally designated as 10 is depicted in FIGS. 1 and 2. The printing apparatus 10 includes a base 12 having first and second portions generally disposed at right angles with respect to one another. A rotatable and reciprocal shaft or rod 14 is supported from the base 12. The shaft 14 is reciprocal between first and second end limits of movement, and is rotatable through at least an arc of approximately 90° about the longitudinal axis of the shaft 14. A sub-assembly or support frame means 16 is connected to the shaft 14 at one end. The support frame 16 is connected to the shaft 14 for reciprocation between the first and second end limits of movement and for rotation through an arc of approximately 90° in conjunction with movement of the shaft 14. The support frame means 16 supports an ink transfer roller 18 and a pressure roller 20. The ink transfer roller 18 and pressure roller 20 are disposed for rotation with respect to respective longitudinal axes, wherein the longitudinal axes are disposed at an angle of approximately 90° with respect to one another, as best seen in FIG. 2 of the drawings. It should be noted that the rollers 18 and 20 can be disposed with their longitudinal axes in the same plane or can be disposed with the longitudinal axes offset from one another in planes parallel to one another and normal to the longitudinal axis of the shaft 14. Ink supply means 22 is supported from the base 12. The ink supply means 22 is adapted to have the ink transfer roller 18 roll across a surface of the ink supply means 22 to evenly distribute a supply of ink onto the peripheral cylindrical surface of the ink transfer roller 18. The rolling contact of the ink transfer roller 18 will occur during reciprocation of the support frame means 16 and shaft 14 from one end limit of movement to the other, while the support frame means and shaft are disposed in a first angular position with the longitudinal axis of the ink transfer roller 18 generally parallel to the surface of the ink supply means 22 and spaced a distance from the surface equal to the radius of the ink transfer roller 18.

An imprint image holder or carrier means 24 is supported from another portion of the base 12. The first and second portions of the base are generally disposed at right angles with respect to one another. The image holder means 24 may include a typeset support 26 and/or a logo and/or graphic image support 28. The imprint image holder means 24 is generally disposed in a plane normal to the planar surface of the ink supply means 22 engaged by the ink transfer roller 18. Ink is transferred from the ink transfer roller 18 to the imprint surface of the image holder means 24 by rotating the support frame means 16 and rotatable shaft 14 from the first angular position to a second angular position, generally disposed at an angular position approximately 90° from one another. This movement brings the longitudinal axis of the ink transfer roller 18 from a position generally parallel to the surface of the ink supply means 22 to a position orientating the longitudinal axis of the ink transfer roller 18 generally perpendicular to the surface of the ink supply means 22, while being generally parallel to the surface of the image to be imprinted and spaced from the image surface by a distance approximately equal to the radius of the ink transfer roller 18. Reciprocation of the shaft 14 and support frame means 16 from one end limit to the other then transfers ink from the ink transfer roller 18 to the surface of the image to be imprinted. After reaching the other end limit of travel, the support frame means 16 and shaft 14 are then rotated in the opposite direction from the second angular position to the first angular position to again orientate the longitudinal axis of the ink transfer roller 18 generally parallel with the surface of the ink supply means 22. When in this first angular position, the longitudinal axis of the pressure roller 20 is brought into a position generally parallel with the surface of the image to be imprinted. The article to be printed is then appropriately positioned over the image holder means 24. The support frame means 16 and reciprocal shaft 14 are then reciprocated from the one end limit to the opposite end limit of movement to interpose the article to be printed between the pressure roller 20 and the surface of the image to be imprinted supported by the carrier means 24. After printing, the article is removed and the support frame means 16 and rotatable shaft 14 are again rotated and reciprocated to transfer ink from the ink transfer roller 18 to the surface of the image to be imprinted as previously described.

In the preferred embodiment, indexing means 30 is provided to index the ink supply means 22 between each use to more evenly apply and distribute ink to the ink transfer roller 18 on subsequent passes. The indexing means 30 can include, as shown in FIGS. 1 and 2, an indexing lever 32 connected to the support frame means 16 adapted to engage a rotatable disk 34 coupled to the ink supply means disk 22 for rotation about a common disk axis. The indexing lever can also act as a guide means for initially orientating the support frame means 16 in at least one of the previously described angular positions. As shown in FIG. 1, and in phantom in FIG. 2, the indexing lever 32 is adapted to engage the rotatable disk 34 when the support frame means 16 is in an angular position to dispose the ink transfer roller 18 in contact with the image support means 24. After inking the image to be imprinted during at least one reciprocal stroke of the rotatable and reciprocal shaft 14 and attached support frame means 16, the shaft and frame means are rotated through an arc of approximately 90° to an orientation as shown in FIG. 2 for subsequent imprinting of a generally flat article.

The article can be held and located with respect to the image support means 24 with an article holder means 36. The article holder means 36 is adjustable with respect to the base 12 for various size articles. The present invention also includes means for driving the shaft 14 and attached support frame means 16 in reciprocation between first and second end limits of movement, and for rotation through an arc of approximately 90° about the longitudinal axis of the shaft 14. In the embodiment depicted in FIGS. 1 and 2, the drive means 38 can include a handle 40 connected to the support frame means 16 for transmission of reciprocal and rotational forces to the shaft and connected support frame means. Of course, it should be apparent to those skilled in the art that the invention described herein may be modified and adapted from the manual power operation as depicted to various degrees of power-driven actuation as desired.

Figure 3:
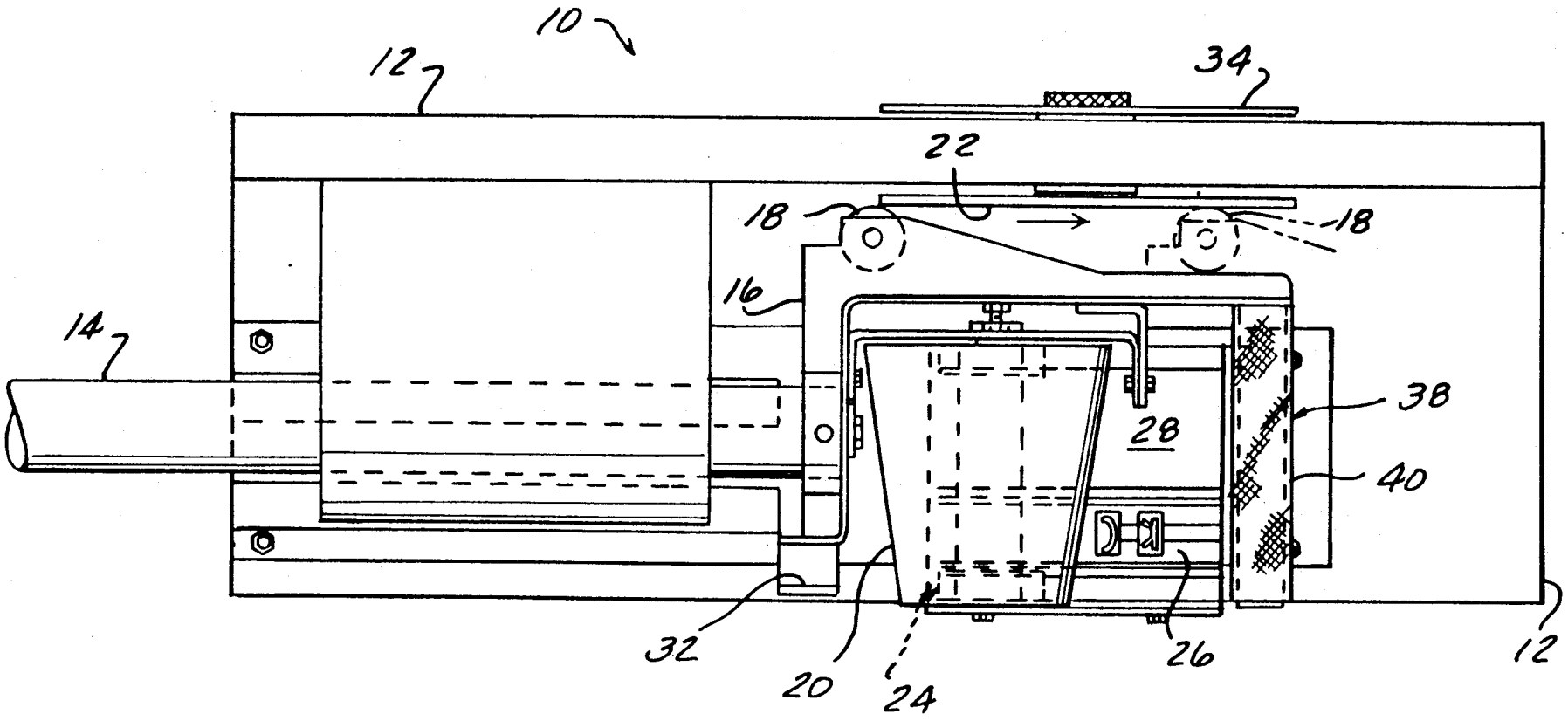
FIG. 3 is a plan view of a second embodiment of the present invention showing a printing apparatus with a second subassembly for imprinting cups.
Figure 4:
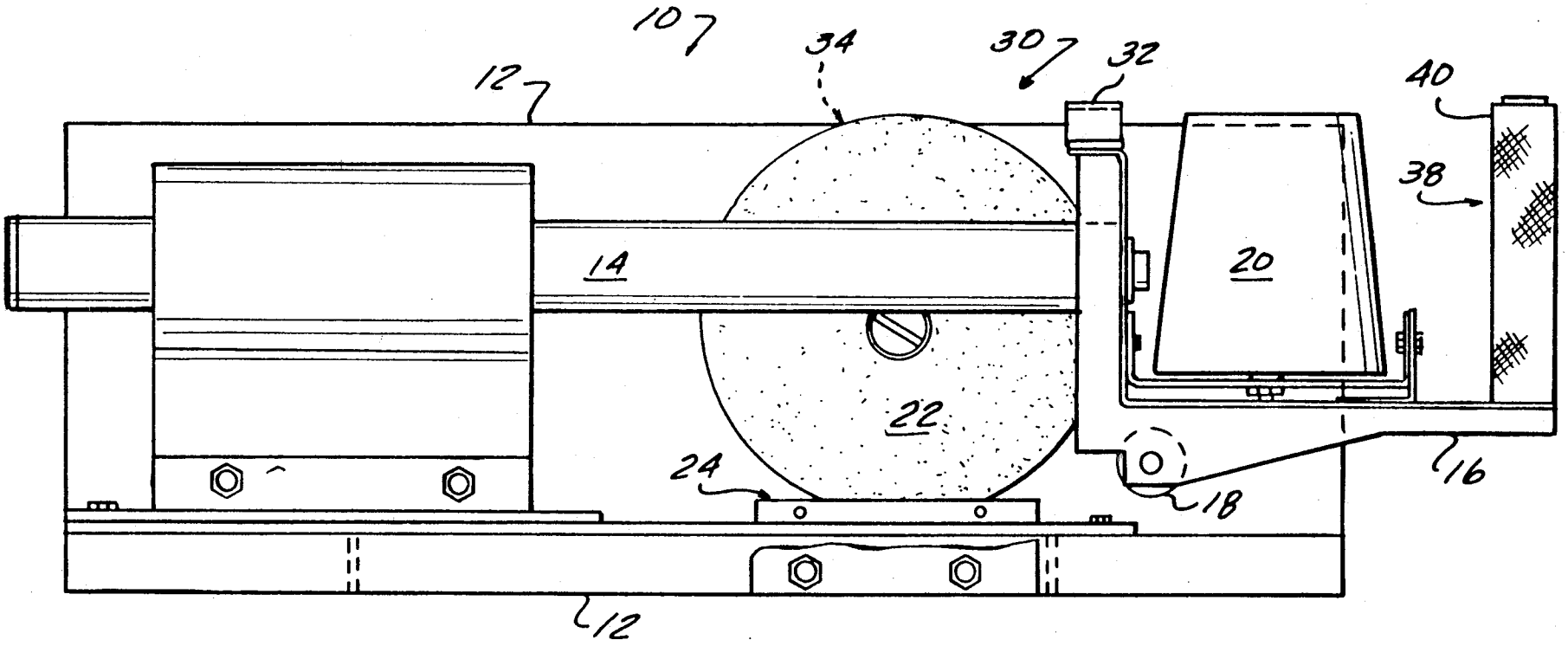
FIG. 4 is a side elevational view showing the second embodiment of the present invention with the shaft and attached second sub-assembly rotated through 90°.
Figure 5:
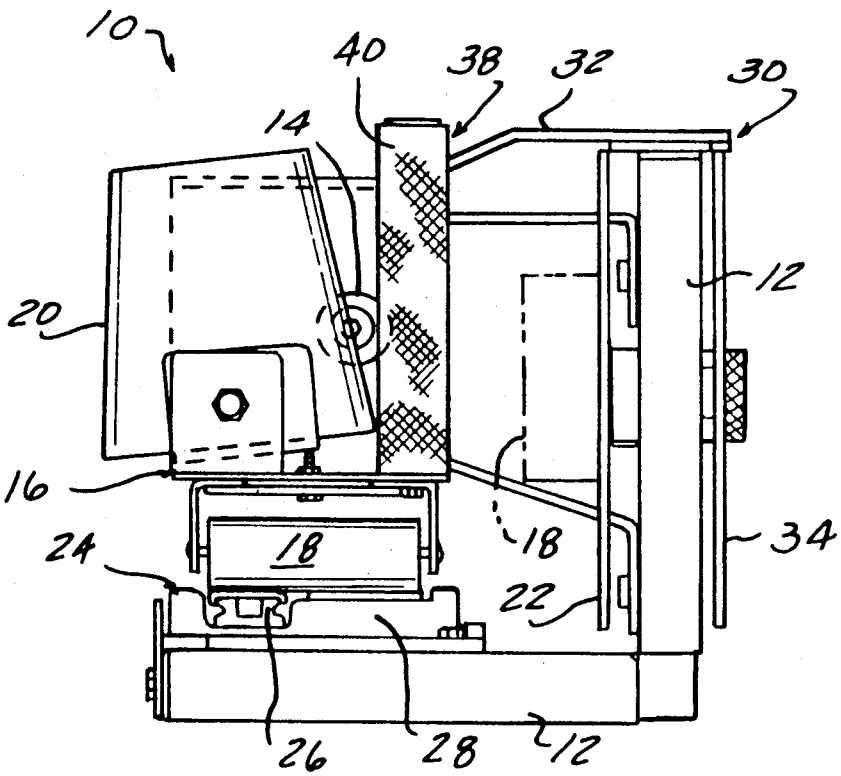
FIG. 5 is an end view of the second embodiment of the present invention as shown in FIG. 4.

The present invention can also be modified, preferably with interchangeable sub-assemblies, from the flat article printing apparatus depicted in FIGS. 1 and 2, to create a cup imprinting apparatus as shown in FIGS. 3 through 5. The general configuration and operation of the modified printing apparatus 10, depicted in FIGS. 3 through 5, is the same as that previously described. The printing apparatus 10 includes a base 12, having first and second base portions generally disposed at approximately right angles with respect to one another. A rotatable and reciprocal shaft or rod 14 is supported from the base 12 for reciprocation between first and second end limits of movement and for rotation through an arc of at least approximately 90° about the longitudinal axis of the shaft 14. A sub-assembly or support frame means 16 is connected to the shaft 14 for reciprocation and rotation therewith. An ink transfer roller 18 is supported by the support frame means 16. The ink transfer roller 18 has a longitudinal axis of rotation generally perpendicular to and offset from the longitudinal axis of the shaft 14. The two respective longitudinal axes are lying in respective parallel planes, spaced apart from one another. A pressure roller 20 is supported by the support frame means 16. The pressure roller 20 in this embodiment of the invention takes the form of a frustum of a right circular cone. The frustum of a right circular cone defining a cup holder means 20 has a longitudinal axis of rotation and is adapted to present a longitudinally extending peripheral conical surface of the held cup disposed in a plane generally normal to the respective parallel planes in which the longitudinal axes of the shaft 14 and ink transfer roller 18 lie, respectively. In other words, the frustum of a right circular cone is disposed such that a longitudinally extending line along the peripheral conical surface defines the tangential intersection of the cup with a plane disposed perpendicular to the previously described parallel planes containing the rotational axes for the shaft 14 and ink transfer roller 18.

Of course, the cup holder means 20 may take a variety of forms other than the frustum of a right circular cone as shown in FIGS. 3 through 5 and described above. In addition, it should be readily apparent that the angular orientations and rotations of the described structure may be modified consistently with one another to orientations other than approximately 90° without departing from the spirit and scope of the present invention. In the present invention, the basic angular orientation is depicted as 90°, which generally defines the angular orientation between the cylindrical peripheral surface of the ink transfer roller 18 and the peripheral conical surface of the pressure roller 20, in FIGS. 3 through 5, or the cylindrical peripheral surface of the pressure roller 20 depicted in FIGS. 1 and 2. In addition, this angular orientation also defines the orientation of the ink supply means 22 with respect to the image support means 24 and the general orientation between the first and second portions of the base 12. This angular orientation can be modified as desired without departing from the spirit of the present invention, provided that it is understood that the present invention teaches the use of an ink supply means 22 and an image carrier means 24 disposed at a selected angular position with respect to one another, and a rotatable and reciprocal shaft 14 having a support frame means 16 connected to one end thereof supporting an ink transfer roller 18 with a cylindrical peripheral surface disposed at approximately the same selected angular orientation with respect to a peripheral surface of a pressure roller 20, both carried by the support frame means 16, such that when in a first angular position, reciprocation of the shaft 14 simultaneously causes transfer of a previously inked image from the image carrier means 24 to a selected article, while the ink transfer roller 18 is resupplied with fresh ink from the ink supply means 22. In addition, another aspect taught by the present invention is an economical and cost effective apparatus for manual and low volume production of custom imprinted articles. Furthermore, yet another aspect taught by the present invention is an interchangeable sub-assembly for converting the printing apparatus 10 from an apparatus adapted for printing flat articles, to an apparatus adapted for printing cups. The interchangeable sub-assembly can take various forms, for example, the entire frame means 16 could be removable and replaceable on the shaft 14, or only a portion of the frame means 16 may be interchangeable, such as the portion supporting the pressure applying means 20.

The image carrier means 24, according to the present invention, can include a typeset support means 26 and/or a logo, graphic or other image support means 28. As previously described, the preferred embodiment of the present invention as depicted, also includes indexing means 30 for automatically moving or re-orientating the ink supply means 22 to present a different path of contact to the ink transfer roller 18 as it passes in contact with the ink supply means 22 for re-inking. The indexing means 30 can take various forms, but as depicted in FIGS. 3 through 5, can include an indexing lever 32 connected to the support frame means 16 for rotation therewith. When in one of the first and second angular positions of the support frame means 16, the indexing lever 32 is adapted to contact a rotatable disk 34 coupled to ink supply means disk 22. As the indexing lever 32 engages the rotatable disk 34, during reciprocal action of the shaft 14 and support frame means 16, the rotatable disk and coupled ink supply means disk 22 are driven in rotation through an arc of less than 90°, and preferably, less than 45°. The ink supply means 22 can be provided with a removable and disposable ink transfer surface, such as an adhesive backed paper for easy cleaning of the printing apparatus 10 and to simplify changing of the ink colors. Means for driving the support frame means 16 and shaft 14, in rotation between first and second angular positions, and in reciprocation between first and second end limits of movement are provided. In the embodiment depicted in FIGS. 3 through 5, the drive means 38 can include a manual handle 40 for powering the printing apparatus 10. However, it should be apparent to those skilled in the art that the printing apparatus 10 of the present invention can be modified, such that the drive means 38 can include power driven operation of the present invention by previously known devices, such as electric, hydraulic, pneumatic, or other fluid and gas mechanical motors without departing from the spirit and scope of the present invention.

While the invention has been described in connection with what is presently considered to be the most practical and preferred embodiments, it is to be understood that the invention is not to be limited to the disclosed embodiments but, on the contrary, is intended to cover various modifications and equivalent arrangements included within the spirit and scope of the appended claims, which scope is to be accorded the broadest interpretation so as to encompass all such modifications and equivalent structures permitted under current law.

What is claimed is:

1. A printing apparatus for forming an ink image on an article, the printing apparatus comprising:

ink storage means for storing a supply of ink;

image carrier means for supporting a selected image to be imprinted on a selected article;

frame means for supporting said ink storage means and said image carrier means;

ink transfer means for transferring ink from said ink storage means to said selected image supported by said image carrier means;

pressure applying means for urging said selected article into contact with said selected image supported by said image carrier means; and shaft means for supporting said ink transfer means and said pressure applying means for rotational displacement between first and second angular positions and for reciprocal displacement while in said first and second angular positions between first and second end limits of movement, such that when in said first angular position, said ink transfer means is engageable with said ink storage means as said shaft means is reciprocated between said first and second end limits of movement, and when in said second angular position, said ink transfer means is engageable with said selected image supported by said image carrier means as said shaft means is reciprocated between said first and second end limits of movement.

2. The printing apparatus of claim 1, further comprising indexing means for moving said ink storage means relative to said frame means.

3. The printing apparatus of claim 1 wherein said shaft means simultaneously disposes said pressure applying means in an operable position to properly engage said selected article with said selected image supported by said image carrier means when in said first angular position during reciprocation between said first and second end limits of movement.

4. The printing apparatus of claim 1 wherein said ink storage means comprises a rotatable disk connected to said frame means, said disk having an inked surface disposed thereon.

5. The printing apparatus of claim 4 further comprising indexing means for rotating said disk relative to said frame means.

6. The printing apparatus of claim 5 wherein said indexing means comprises an indexing lever connected to said shaft means, said indexing lever engageable with a portion of said frame means when reciprocating between said first and second end limits of movement and when in said second angular position, said indexing lever adapted for driving said disk in rotation.

7. The printing apparatus of claim 1 wherein said pressure applying means comprises a roller connected to said shaft means adapted to interpose said selected article between said roller and said selected image supported by said image carrier means when reciprocated between said first and second end limits of movement in said first angular position.

8. The printing apparatus of claim 1 wherein said pressure applying means comprises cup holder means connected to said shaft means and adapted to support a cup with a longitudinally extending peripheral conical surface of said cup in a parallel planar orientation with respect to said selected image supported by said image carrier means, such that said cup is rotatable as it engages said selected image for transfer of said selected inked image to said cup as said cup holder means is reciprocated between said first and second end limits of movement.

9. The printing apparatus of claim 1 wherein said pressure applying means comprises a pressure roller connected to said shaft means such that a longitudinally extending peripheral cylindrical surface of said pressure roller is disposed in a parallel planar orientation with respect to said selected image supported by said image carrier means, such that said pressure roller is rotatable as it engages said selected article between said pressure roller and said selected image for transfer of said selected inked image to said selected article.

10. The printing apparatus of claim 1 further comprising means for driving said shaft means in reciprocal movement between said first and second end limits of movement and for rotating said shaft means between said first and second angular positions.

11. The printing apparatus of claim 10 wherein said drive means comprises a handle connected to said shaft means for manual manipulation of said shaft means.

12. The printing apparatus of claim 1 wherein said first and second angular positions are disposed at an angle of approximately 90° with respect to one another.

13. A method for forming an ink image on an article, the method comprising the steps of:

rotating a shaft and connected assembly into a first angular position to align an ink transfer roller with respect to an ink supply means when said shaft is in a first end limit of movement;

when in said first angular position, reciprocating said shaft and attached assembly from said first end limit of movement to a second end limit of movement;

rollingly engaging said ink transfer roller with said ink supply means as said assembly and connected shaft proceed between said first and second end limits of movement;

after reaching said second end limit of movement, rotating said shaft from said first angular position to a second angular position to align said ink transfer roller with a selected image supported by an image carrier means;

when in said second angular position, reciprocating said shaft and connected assembly from said second end limit of movement to said first end limit of movement; and applying ink to said selected image supported by said image carrier means from said ink transfer roller as said shaft and connected assembly moves between said second end limit of movement and said first end limit of movement.

14. The method of claim 13, further comprising the step of:

when in said first angular position, transferring ink from said selected image carried by said image carrier means to a selected article with a pressure roller supported by said assembly connected to said shaft as said shaft and connected assembly moves between said first and second end limits of movement.

15. The method of claim 13, further comprising the step of:

indexing said ink supply means with respect to a path of said ink transfer roller, as said shaft and connected assembly move between said second end limit of movement to said first end limit of movement when in said second angular position.

16. The method of claim 13, further comprising the steps of:

simultaneously re-inking said ink transfer roller while transferring a previously inked selected image to a selected article with a pressure roller carried by said assembly connected to said shaft when said shaft is reciprocated in a first direction and orientated in said first angular position; and simultaneously transferring ink from said ink transfer roller to said selected image supported by said image carrier means while indexing said ink supply means with respect to a fixed path of said ink transfer roller when stroking said shaft in an opposite direction and orientated in said second angular position.

17. A printing apparatus, comprising:

stationary frame means having first and second portions disposed at an angle with respect to one another;

ink storage means for supplying a quantity of ink;

image carrier means for supporting a selected image to be imprinted on a selected article;

ink transfer means for transferring ink from said ink storage means to said selected image supported by said image carrier means;

pressure applying means for pressing said selected article into contact with said selected image after inking; and movable means for supporting said ink transfer means and said pressure applying means adapted for rotative movement between first and second angular positions and for reciprocation between first and second end limits of movement, wherein said ink transfer means is movable into contact with said ink supply means when in said first angular position as said movable means is reciprocated between said first and second end limits of movement, and wherein said ink transfer means is movable into contact with said selected image supported by said image carrier means when in said second angular position as said movable means is reciprocated between said first and second end limits of movement.

18. The printing apparatus of claim 17, further comprising indexing means for moving said ink storage means relative to a fixed path of said ink transfer means.

19. The printing apparatus of claim 17 wherein said movable means simultaneously disposes said pressure applying means in an operable position to engage said selected article with said selected image supported by said image carrier means after inking, when in said first angular position while being reciprocated between said first and second end limits of movement.

20. The printing apparatus of claim 17 wherein said pressure applying means comprises a cup support means connected to said movable means and adapted to support a cup in proper orientation with respect to said selected image supported by said image carrier means, such that said cup is rotatable as it engages said selected image for transferring an inked copy of said selected image to said cup as said movable means is reciprocated between said first and second end limits of movement in said first angular position.

* * * * *